US008973562B2

(12) United States Patent
Tanaya

(10) Patent No.: US 8,973,562 B2
(45) Date of Patent: Mar. 10, 2015

(54) IGNITION DEVICE AND IGNITION METHOD FOR INTERNAL COMBUSTION ENGINE

(75) Inventor: Kimihiko Tanaya, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 268 days.

(21) Appl. No.: 13/611,850

(22) Filed: Sep. 12, 2012

(65) Prior Publication Data

US 2013/0263834 A1 Oct. 10, 2013

(30) Foreign Application Priority Data

Apr. 9, 2012 (JP) ..... 2012-088403

(51) Int. Cl.
*F02P 15/08* (2006.01)
*F02P 15/10* (2006.01)

(52) U.S. Cl.
CPC *F02P 15/08* (2013.01); *F02P 15/10* (2013.01)
USPC ..... 123/636; 123/620

(58) Field of Classification Search
CPC ..... F02P 15/08; F02P 15/10
USPC ..... 123/623, 620, 636, 650, 651, 655, 123/406.12; 315/111.21, 111.51; 361/254
See application file for complete search history.

(56) References Cited

U.S. PATENT DOCUMENTS 3,945,362 A * 3/1976 Neuman et al. ..... 123/606
4,326,493 A * 4/1982 Merrick ..... 123/606
4,381,757 A * 5/1983 Morino et al. ..... 123/606
4,911,126 A * 3/1990 Notaras et al. ..... 123/406.54
6,694,959 B1 * 2/2004 Miwa et al. ..... 123/637
7,404,396 B2 * 7/2008 Toriyama et al. ..... 123/598
2008/0121214 A1 * 5/2008 Bertsch et al. ..... 123/406.12

FOREIGN PATENT DOCUMENTS

JP 2001-050147 A 2/2001
JP 2009-13866 A 1/2009
JP 2010-096128 A 4/2010

OTHER PUBLICATIONS

Japanese Office Action, Jun. 25, 2013, Patent Application No. 2012-088403.

* cited by examiner

*Primary Examiner* — Mahmoud Gimie

(74) *Attorney, Agent, or Firm* — Sughrue Mion, PLLC; Richard C. Turner

(57) ABSTRACT

The ignition device for the internal combustion engine includes: an ignition plug including a first electrode and a second electrode opposed to each other via a predetermined gap, for generating in the predetermined gap a spark discharge for igniting a combustible mixture in a combustion chamber of the internal combustion engine; an ignition coil including a primary coil and a secondary coil, for generating a high voltage in the secondary coil by supplying or stopping a primary current flowing through the primary coil, and then applying the generated high voltage to the first electrode; and a control unit for driving the ignition coil for a plurality of times within a single ignition process, and changing a primary voltage for driving the ignition coil within the single ignition process.

13 Claims, 3 Drawing Sheets

IGNITION DEVICE AND IGNITION METHOD FOR INTERNAL COMBUSTION ENGINE

BACKGROUND OF THE INVENTION

1. Field of the Invention

The present invention relates to an ignition device and an ignition method for an internal combustion engine for igniting a combustible mixture in a combustion chamber of the internal combustion engine.

2. Description of the Related Art

In recent years, there have been posed problems such as the environmental conservation and the fuel exhaustion, and a response to those problems is an urgent matter in the automobile industry. As measures to these problems, the ultra-lean combustion (stratified lean combustion) operation of an engine using a stratified mixture, for example, is known. However, a distribution of a combustible mixture may vary in the stratified lean combustion, and an ignition device capable of absorbing this variation is required.

In order to satisfy the above-mentioned requirement, there is proposed an ignition device, which includes an ignition plug for generating a spark discharge in a combustion chamber and a microwave generation device for feeding energy to the spark discharge of the ignition plug (refer to Japanese Patent Application Laid-open No. 2010-96128, for example).

This ignition device can form large discharge plasma, increase spatial ignition opportunities, and absorb the variation in distribution of the combustible mixture. Therefore, the ignition device can satisfy the requirement for the stratified lean combustion.

However, the related art has the following problems.

The ignition device described in Japanese Patent Application Laid-open No. 2010-96128 can form large discharge plasma, and hence can prevent a misfire to restrain a variation in generated torque, but a passage for supplying the microwave into the combustion chamber is required in addition to the ignition plug. Therefore, there is a problem in that it is difficult to apply the ignition device according to Japanese Patent Application Laid-open No. 2010-96128 to an existing engine.

Moreover, in the combustion chamber, a large change in pressure is repeated by a reciprocal motion of a piston, and the formation and an extinction of plasma are repeated by the discharge and combustion, which leads to a very unstable state. Therefore, there is a problem in that a stable supply of high frequency energy such as the microwave to the combustion chamber is very difficult in impedance matching and the like technically and in terms of matching individual products.

SUMMARY OF THE INVENTION

The present invention has been made in view of the above-mentioned problems, and therefore has an object to provide an ignition device and an ignition method for an internal combustion engine, which are capable of easily forming large discharge plasma with a simple configuration.

According to an exemplary embodiment of the present invention, there is provided an ignition device for an internal combustion engine, including: an ignition plug including a first electrode and a second electrode opposed to each other via a predetermined gap, for generating in the predetermined gap a spark discharge for igniting a combustible mixture in a combustion chamber of the internal combustion engine; an ignition coil including a primary coil and a secondary coil, for generating a high voltage in the secondary coil by supplying or stopping a primary current flowing through the primary coil, and then applying the generated high voltage to the first electrode; and a control unit for driving the ignition coil for a plurality of times within a single ignition process, and changing a primary voltage for driving the ignition coil within the single ignition process.

According to an exemplary embodiment of the present invention, there is also provided an ignition method for an internal combustion engine, the internal combustion engine including: an ignition plug including a first electrode and a second electrode opposed to each other via a predetermined gap, for generating in the predetermined gap a spark discharge for igniting a combustible mixture in a combustion chamber of the internal combustion engine; and an ignition coil including a primary coil and a secondary coil, for generating a high voltage in the secondary coil by supplying or stopping a primary current flowing through the primary coil, and then applying the generated high voltage to the first electrode, the ignition method including driving the ignition coil for a plurality of times within a single ignition process, and changing a primary voltage for driving the ignition coil within the single ignition process.

According to the ignition device and the ignition method for the internal combustion engine according to the present invention, the control unit (control step) drives the ignition coil for a plurality of times within a single ignition process, and changes the primary voltage for driving the ignition coil within the single ignition process.

Therefore, large discharge plasma can easily be formed with the simple configuration.

DETAILED DESCRIPTION OF THE PREFERRED EMBODIMENTS

Figure 1:
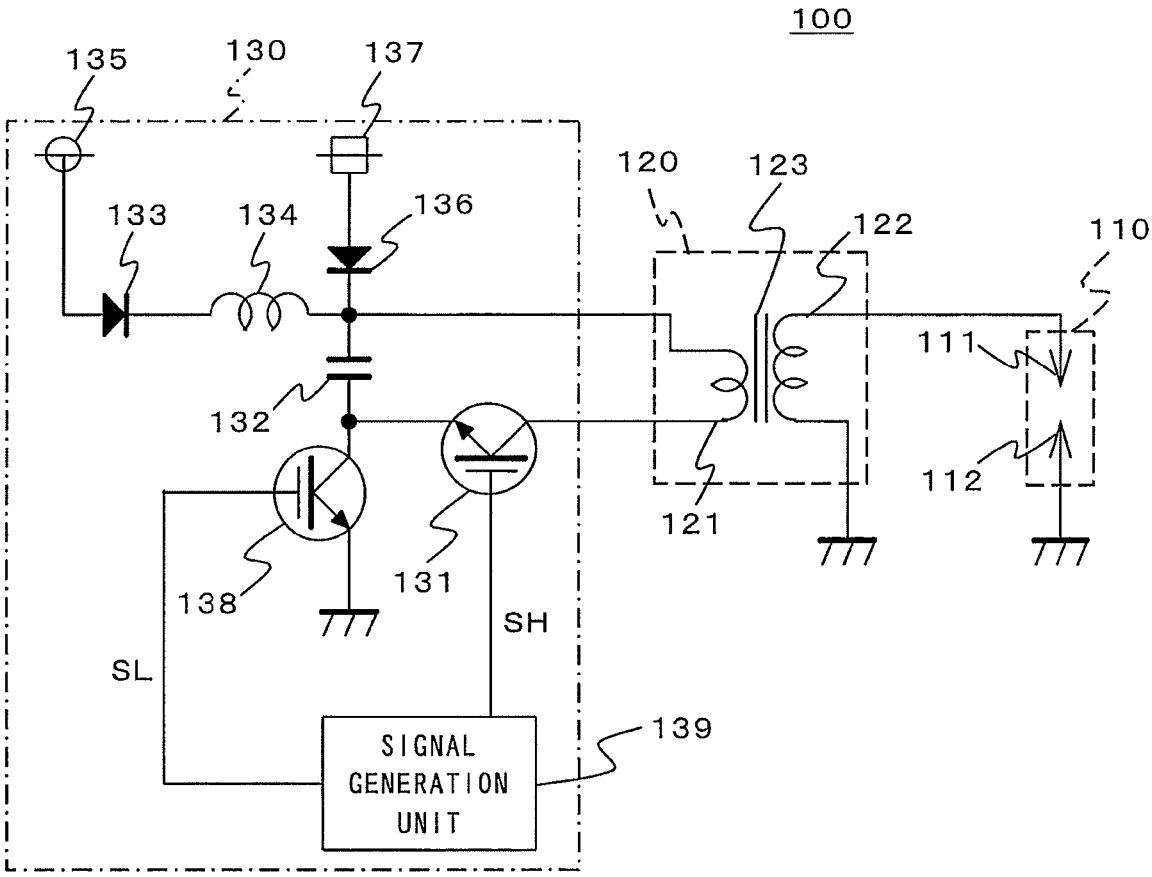
FIG. 1 is a configuration diagram illustrating an ignition device for an internal combustion engine according to a first embodiment of the present invention.

A description is now given of preferred embodiments of an ignition device and an ignition method for an internal combustion engine according to the present invention, referring to the drawings. The same or corresponding components are denoted by the same reference symbols throughout the drawings.

The ignition device and the ignition method for the internal combustion engine according to the present invention can be installed on a motor vehicle, a motor cycle, an outboard motor, and other special machines which use an internal combustion engine, and surely ignite a fuel so that the internal combustion engine can be efficiently operated. Therefore, the ignition device and the ignition method for the internal combustion engine according to the present invention are useful for the environmental conservation and the fuel exhaustion problem.

First Embodiment

FIG. 1 is a configuration diagram illustrating an ignition device 100 for an internal combustion engine according to a first embodiment of the present invention. In FIG. 1, the ignition device 100 includes an ignition plug 110 for generating a spark discharge for igniting a combustible mixture in a combustion chamber (not shown) of the internal combustion engine, an ignition coil 120 for applying a predetermined high voltage to the ignition coil 110 and feeding a current to the ignition coil 110, and a control unit 130 for controlling an operation of the ignition coil 120.

A description is now given of a configuration and a function of each component of this ignition device 100.

The ignition plug 110 includes a high voltage electrode 111 as a first electrode and an outer electrode 112 as a second electrode, which is opposed to the high voltage electrode 111 via a predetermined gap (hereinafter, referred to as "main plug gap").

The ignition coil 120 includes a primary coil 121, a secondary coil 122, and an iron core 123 for magnetically coupling the primary coil 121 and the secondary coil 122. One end of the secondary coil 122 is connected to the high voltage electrode 111 of the ignition plug 110, and the other end thereof is connected to a ground (GND).

The control unit 130 includes a first switching element 131, an ignition capacitor 132, a first rectifier diode 133, an inductor 134, a first power supply 135, a second rectifier diode 136, a second power supply 137, a second switching element 138, and a signal generation unit 139.

The ignition capacitor 132 is connected between both ends of the primary coil 121 via the first switching element 131 constituted by an insulated gate bipolar transistor (IGBT). To a positive electrode side of the ignition capacitor 132, the first power supply 135 is connected via the first rectifier diode 133 and the inductor 134, and the second power supply 137 is connected via the second rectifier diode 136.

A negative electrode side of the ignition capacitor 132 is connected to the GND via the second switching element 138 constituted by an IGBT. Moreover, a base of the first switching element 131 and a base of the second switching element 138 are connected to the signal generation unit 139.

On this occasion, the second power supply 137 is a power supply which can apply a voltage twice or more as high as a voltage which the first power supply 135 can apply. For example, the first power supply 135 and the second power supply 137 are selected as a 100 V power supply and a 1,000 V power supply, respectively, according to the first embodiment of the present invention.

Switching of the first switching element 131 and the second switching element 138 is controlled respectively by a first control signal SH and a second control signal SL from the signal generation unit 139 constituted by a microprocessor (micro-processing unit: MPU). The signal generation unit 139 sets the number and timings of operations of the ignition coil 120 in accordance with an operation state of the internal combustion engine, thereby generating the first control signal SH and the second control signal SL.

Note that, the signal generation unit 139, the first switching element 131, and the second switching element 138 constitute a capacitive current supply unit for supplying the primary side of the ignition coil 120 with a capacitive current by means of a charge accumulated in the ignition capacitor 132, and the capacitive current supply unit constitutes a part of the control unit 130 for controlling the operation of the ignition coil 120.

On this occasion, a primary current I1 flowing through the primary coil 121 of the ignition coil 120 is constituted by a capacitive current from the ignition capacitor 132 which flows on a discharge path which starts from the positive electrode side of the ignition capacitor 132, passes through the primary coil 121 and a collector and an emitter of the first switching element 131, and returns to the negative electrode side of the ignition capacitor 132.

Therefore, as the electric charge accumulated in the ignition capacitor 132 increases and the voltage for charging the ignition capacitor 132 increases, the value of the primary current I1 increases and the secondary voltage generated on the secondary side of the ignition coil 120 increases. Therefore, "a large current" can be supplied, and "a high voltage" can be applied by setting the electrostatic capacity C of the ignition capacitor 132 and the charge voltage to appropriate values.

On this occasion, the ignition capacitor 132 is charged through a charge path which starts from the first power supply 135, the first rectifier diode 133, and the inductor 134, or starts from the second power supply 137 and the second rectifier diode 136, passes through the positive electrode side of the ignition capacitor 132, the negative electrode side of the ignition capacitor 132, a collector and an emitter of the second switching element 138, and reaches the GND.

Moreover, the ignition capacitor 132 is connected to the first power supply 135 via the inductor 134, and hence the charge current flowing from the first power supply 135 to the ignition capacitor 132 is amplified at a cycle of a so-called LC resonance determined by the electrostatic capacity C of the ignition capacitor 132 and the inductance L of the inductor 134.

In other words, the ignition capacitor 132 can be charged very quickly to a voltage higher than the voltage 100 V of the first power supply 135, approximately 200 V, for example, by setting the electrostatic capacity C of the ignition capacitor 132 and the inductance L of the inductor 134 to appropriate values.

Moreover, the ignition capacitor 132 is connected to a voltage higher than the voltage charged by means of the LC resonance from the first power supply 135, namely, the second power supply 137 at 1,000 V according to the first embodiment. Therefore, though the charge takes time, the ignition capacitor 132 can be charged to the voltage higher than the voltage brought about by the charge from the first power supply 135 via the first rectifier diode 133 and the inductor 134.

A description is now given of a method of forming the discharge plasma in this ignition device 100.

It is necessary to supply the main plug gap of the ignition plug 110 with "a large current" "repeatedly in a short period" in order to form large discharge plasma in the main plug gap. For example, as the current supplied to the main plug gap increases, more plasma is formed.

However, the plasma concentrates around the discharge path, and hence discharge plasma in a desired volume is not formed by simply increasing the discharge current. The discharge needs to be generated for a plurality of times, namely, a multi-ignition is necessary in order to distribute the formed plasma in a spatially wide area.

Specifically, the plasma is generated in the main plug gap of the ignition plug 110 by the discharge generated in the main plug gap. On this occasion, when the discharge is discontinued, the plasma takes various forms such that a part of the plasma is diffused by its own heat, another part thereof flows along with the combustible mixture in the combustion chamber of the internal combustion engine, and still another part thereof disappears.

On this occasion, when the discharge is discontinued and a predetermined high voltage is applied to the main plug gap in order to generate again the discharge in the main plug gap, the charge is resumed on a path lower in impedance in the main plug gap.

This path lower in impedance varies and may be a path high in plasma density, or may be a path of the shortest distance in the main plug gap. Therefore, a probability that a discharge is generated again on a path different from a previous discharge path is increased by the multi-ignition.

In other words, the so-called multi-ignition, which simply repeats the ignition, cannot form sufficient plasma by a single discharge, and hence cannot form large discharge plasma as a whole. Further, a simple increase in the discharge current results in a narrow supply range of the plasma, and cannot form large discharge plasma.

In contrast, according to the first embodiment of the present invention, the discharge current which can form sufficient plasma can be supplied and plasma is formed repeatedly in a wide area from spatially different locations by the multi-ignition, resulting in formation of large discharge plasma.

In view of the above, the signal generation unit 139 controls the first switching element 131 and the second switching element 138 so that the discharge is started again in an interval that is shorter than that in which the plasma formed in the main plug gap of the ignition plug 110 entirely disappears, and that allows the formed plasma to be appropriately diffused.

Figure 2:
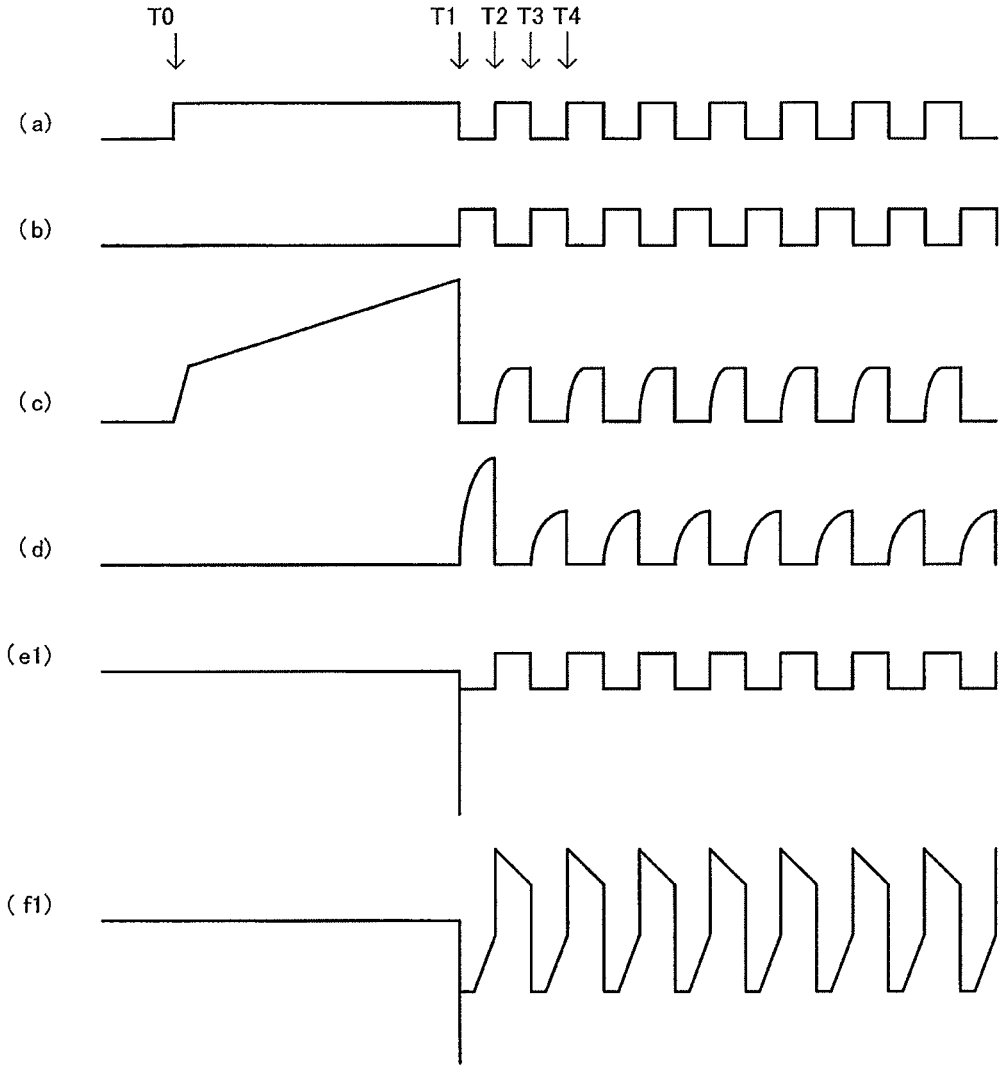
FIG. 2 is a timing chart illustrating an operation of the ignition device for the internal combustion engine according to the first embodiment of the present invention.

Referring to a timing chart in FIG. 2, a description is now given of an operation of the ignition device 100 for the internal combustion engine according to the first embodiment of the present invention.

In FIG. 2, part (a) illustrates the second control signal SL output to the base of the second switching element 138, part (b) illustrates the first control signal SH output to the base of the first switching element 131, part (c) illustrates a potential difference between the both ends of the ignition capacitor 132, part (d) illustrates the primary current I1 flowing through the primary coil 121 of the ignition coil 120, part (e1) illustrates the voltage applied to the high voltage electrode 111 of the ignition plug 110, and part (f1) illustrates a waveform of a discharge current I2 flowing through the main plug gap.

When the second control signal SL from the signal generation unit 139 reaches the H level at a timing corresponding to a time T0 of FIG. 2, the second switching element 138 is brought into the ON state. On this occasion, the first control signal SH from the signal generation unit 139 is at the L level, and the first switching element 131 is thus in the OFF state.

When the second switching element 138 is brought into the ON state, the ignition capacitor 132 is quickly charged from the first power supply 135 up to approximately 200 V, which is approximately twice as high as the voltage of the first power supply 135, in a very short period by the LC resonance via the above-mentioned charge path as illustrated in part (c) of FIG. 2.

Further, the ignition capacitor 132 is slowly charged up to approximately 1,000 V, which is the voltage of the second power supply 137, from the second power supply 137. Note that, the charge by the second power supply 137 is slow, and hence a sufficient period is set for a charge period (period from the time T0 to a time T1).

Moreover, the first control signal SH and the second control signal SL are output from the signal generation unit 139 so that, when one of the first control signal SH and the second control signal SL is at the H level, the other of the first control signal SH and the second control signal SL is at the L level in an ignition operation at the time T0 and thereafter. As a result, switching control is provided for the first switching element 131 and the second switching element 138 so that, when one of the first switching element 131 and the second switching element 138 is in the ON state, the other of the first switching element 131 and the second switching element 138 is in the OFF state.

When the first control signal SH from the signal generation unit 139 reaches the H level at a timing corresponding to the time T1 of FIG. 2, the first switching element 131 is brought into the ON state. On this occasion, the second control signal SL from the signal generation unit 139 reaches the L level, and the second switching element 138 is thus brought into the OFF state.

When the first switching element 131 is brought into the ON state, the capacitive current of the ignition capacitor 132 charged to approximately 1,000 V flows as the primary current I1 through the ignition coil 120 on the above-mentioned path.

On this occasion, the primary current I1 is caused to quickly flow in accordance with the charged voltage 1,000V, which is higher than the ordinary voltage 200 V brought about by the first power supply 135, and hence a secondary voltage, which is higher than an ordinary voltage, is generated on the secondary side of the ignition coil 120.

For example, in a case where the ignition capacitor 132 is charged to 200 V and the primary current I1 is caused to flow, if the secondary voltage generated on the secondary side of the ignition coil 120 is approximately 10 kV, the secondary voltage of approximately 50 kV can be generated on the secondary side of the ignition coil 120 when the ignition capacitor 132 is charged to 1,000 V and the primary current I1 is caused to flow.

Moreover, a configuration in which a negative high voltage is generated on the high voltage electrode 111 of the ignition plug 110 at the time T1 is provided. In other words, in order to surely generate a dielectric breakdown in the main plug gap at the time T1, attention is paid so that the negative high voltage, which more easily generates the dielectric breakdown, is applied to the high voltage electrode 111. As a result, the dielectric breakdown can be surely generated in the main plug gap at the time T1.

When an attempt is made to increase the secondary current (discharge current I2) flowing through the secondary coil 122 of the ignition coil 120, the secondary voltage generated on the secondary coil 122 decreases, and hence dielectric breakdown may not be generated in the main plug gap of the ignition plug 110. As a result, a misfire state may be brought about.

However, as described in the first embodiment of the present invention, the dielectric breakdown can surely be generated by supplying the primary current I1 in accordance with the voltage higher than the ordinary voltage in the initial period of the multi-ignition.

Therefore, even if the ignition coil 120 is configured by a current-oriented specification, such as a specification in which a turn ratio between the primary coil 121 and the secondary coil 122 is equal to or less than 80, instead of a conventional voltage-oriented type specification, a dielectric breakdown can surely be generated in the main plug gap, and a large discharge current I2 can be caused to flow.

Next, when the first control signal SH reaches the L level at a timing corresponding to the time 12 of FIG. 2, the first switching element 131 is brought into the OFF state. On this occasion, the primary current I1 from the ignition capacitor 132 is stopped, and the second control signal SL simultaneously reaches the H level. As a result, the second switching element 138 is brought into the ON state.

When the second switching element 138 is brought into the ON state, the ignition capacitor 132 is quickly charged from the first power supply 135 up to approximately 200 V, which is approximately twice as high as the voltage of the first power supply 135, in a very short period by the LC resonance via the above-mentioned charge path.

A period between the time T2 and a time T3 of FIG. 2 is short for charging the ignition capacitor 132 by the second power supply 137, and the charged voltage of the ignition capacitor 132 hardly increases in this period. In other words, the charged voltage remains approximately 200 V at the time T3.

Moreover, the dielectric breakdown has already been generated in the main plug gap between the high voltage electrode 111 and the outer electrode 112 of the ignition plug 110 at the time T1, thereby forming a discharge path. Therefore, subsequently, generation of a high secondary voltage is no longer necessary unless the discharge is discontinued for a while, and the discharge current I2 can be cause to flow through the discharge path in the main plug gap by a voltage of approximately 500 V, for example.

At the timing corresponding to the time T2 and thereafter of FIG. 2, the first control signal SH and the second control signal SL are alternately switched between the H level and the L level in a short period at the time T3 and a time T4. As a result, the conduction states of the first switching element 131 and the second switching element 138 alternately change as described above, and the primary current I1 flows repeatedly in the each short period in the ignition coil 120.

In the ignition device 100 for the internal combustion engine according to the first embodiment of the present invention illustrated in FIG. 1, the first switching element 131 repeats the ON state and the OFF state, and the secondary current (discharge current I2) flowing through the secondary side of the ignition coil 120 thus flows as an alternate current as illustrated in part (f1) of FIG. 2.

As described above, according to the first embodiment, the control unit drives the ignition coil a plurality of times within a single ignition process, and changes the primary voltage for driving the ignition coil within the single ignition process. Therefore, large discharge plasma can be easily formed with the simple configuration.

Moreover, as described above, the high secondary voltage is generated to form the discharge path in the main plug gap by causing the primary current to flow in accordance with the voltage higher than the ordinary voltage at the initial period of the multi-ignition. Subsequently, the primary current is caused to flow at the voltage lower than the voltage at the initial period of the multi-ignition, and hence it is possible to continuously feed the large discharge current though the discharge path in the main plug gap.

Therefore, the large discharge plasma can be efficiently formed, and a large amount of plasma can be fed to a wide area in the combustion chamber of the internal combustion engine, thereby facilitating the combustion reaction. As a result, a limit region and the like of the lean combustion or the diluted combustion can be extended.

In other words, the large alternate discharge current can be supplied between the electrodes of the ignition plug in an early period, and hence the large plasma can be formed with the simple configuration, resulting in the stable lean combustion. As a result, the fuel used for the operation of the internal combustion engine can be significantly reduced, thereby largely reducing the quantity of emission of $CO_2$, and contributing to the environmental conservation.

Second Embodiment

According to the first embodiment, by increasing the charged voltage of the ignition capacitor 132 in the initial period of the multi-ignition operation, the primary current I1 is caused to quickly flow on the primary side of the ignition coil 120, thereby supplying the high voltage electrode 111 of the ignition plug 110 with the secondary voltage, as the negative high voltage, which is generated by so called "magnetic excitation" when the current flows in. As a result, the dielectric breakdown is generated in the main plug gap, and the discharge path is formed.

On this occasion, "release of magnetic flux" has an opposite meaning of "magnetic excitation". Moreover, it is known that a higher secondary voltage is more easily generated at the time of the "release of magnetic flux". In other words, the electromotive force of the coil is proportional to a quantity of a temporal change in the magnetic flux. Moreover, the numbers of turns of the coils of the ignition coil 120 are not variable elements, and hence it can also be rephrased that the electromotive force of the coil is proportional to a quantity of temporal change in current. Moreover, the coil has inductance, and it is thus difficult to instantaneously flow a required current but it is easy to stop a flowing current.

Considering these points, a high voltage can be more efficiently generated by employing the "release of magnetic flux", and hence an ignition coil 120 having a small turn ratio can be employed. As a result, a larger discharge current I2 can be caused to flow in the discharge path in the main plug gap.

Figure 3:
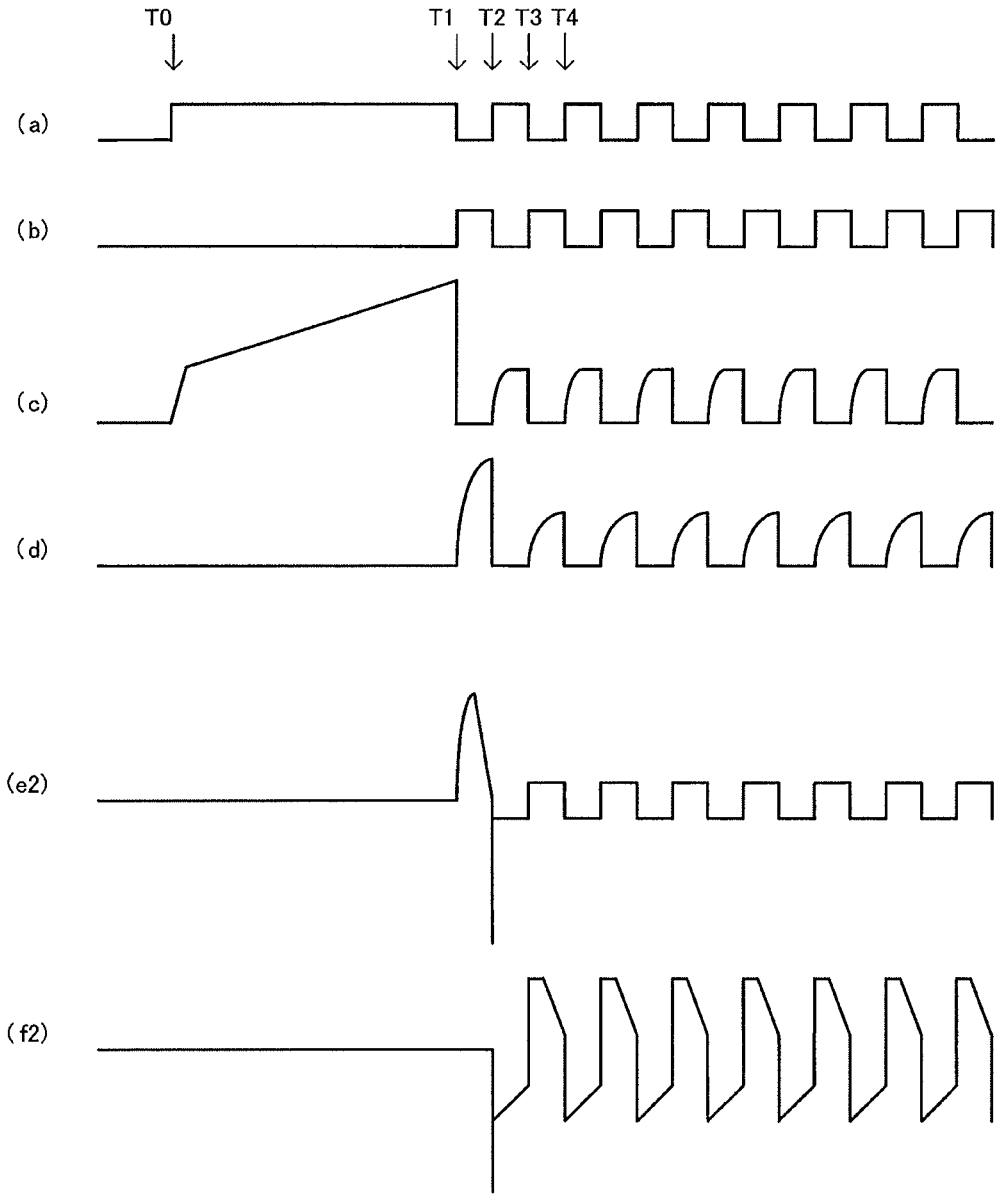
FIG. 3 is a timing chart illustrating an operation of an ignition device for an internal combustion engine according to a second embodiment of the present invention.

Referring to a timing chart in FIG. 3, a description is now given of an operation of the ignition device 100 for the internal combustion engine according to the second embodiment of the present invention. Note that, the configuration of the ignition device 100 of the internal combustion engine according to the second embodiment of the present invention is the same as that of the first embodiment described above, and a description thereof is therefore omitted.

In FIG. 3, part (a) illustrates the second control signal SL output to the base of the second switching element 138, part (b) illustrates the first control signal SH output to the base of the first switching element 131, part (c) illustrates a potential difference between the both ends of the ignition capacitor 132, part (d) illustrates the primary current I1 flowing through the primary coil 121 of the ignition coil 120, part (e2) illustrates the voltage applied to the high voltage electrode 111 of the ignition plug 110, and part (f2) illustrates a waveform of a discharge current I2 flowing through the main plug gap.

When the second control signal SL from the signal generation unit 139 reaches the H level at a timing corresponding to a time T0 of FIG. 3, the second switching element 138 is brought into the ON state. On this occasion, the first control signal SH from the signal generation unit 139 is at the L level, and the first switching element 131 is thus in the OFF state.

When the second switching element 138 is brought into the ON state, the ignition capacitor 132 is quickly charged from the first power supply 135 up to approximately 200 V, which is approximately twice as high as the voltage of the first power supply 135, in a very short period by the LC resonance via the above-mentioned charge path illustrated in part (c) of FIG. 3.

Further, the ignition capacitor 132 is slowly charged up to approximately 1,000 V, which is the voltage of the second power supply 137, from the second power supply 137. Note that, the charge by the second power supply 137 is slow, and hence a sufficient period is set for a charge period (period from the time T0 to a time T1).

Moreover, the first control signal SH and the second control signal SL are output from the signal generation unit 139 so that, when one of the first control signal SH and the second control signal SL is at the H level, the other of the first control signal SH and the second control signal SL is at the L level in an ignition operation at the time T0 and thereafter. As a result, switching control is provided for the first switching element 131 and the second switching element 138 so that, when one of the first switching element 131 and the second switching element 138 is in the ON state, the other of the first switching element 131 and the second switching element 138 is in the OFF state.

When the first control signal SH from the signal generation unit 139 reaches the H level at a timing corresponding to the time T1 of FIG. 3, the first switching element 131 is brought into the ON state. On this occasion, the second control signal SL from the signal generation unit 139 reaches the L level, and the second switching element 138 is thus brought into the OFF state.

When the first switching element 131 is brought into the ON state, the capacitive current of the ignition capacitor 132 charged to approximately 1,000 V flows as the primary current I1 through the ignition coil 120 on the above-mentioned path to generate a secondary voltage on the secondary side of the ignition coil 120.

The circuit is configured so that the secondary voltage generated by this "magnetic excitation" is applied as a positive high voltage to the high voltage electrode 111 of the ignition plug 110. On this occasion, if a dielectric breakdown is not generated in the main plug gap at the time T1, more magnetic flux is accumulated in the iron core 123 of the ignition coil 120.

Next, when the first control signal SH reaches the L level at a timing corresponding to the time T2 of FIG. 3, the first switching element 131 is brought into the OFF state. On this occasion, the primary current I1 from the ignition capacitor 132 is stopped, and the second control signal SL simultaneously reaches the H level. As a result, the second switching element 138 is bought into the ON state.

When the second switching element 138 is brought into the ON state, the ignition capacitor 132 is quickly charged from the first power supply 135 up to approximately 200 V, which is approximately twice as high as the voltage of the first power supply 135, in a very short period by the LC resonance via the above-mentioned charge path.

On this occasion, the time T2 is set to a timing in which the primary current I1 flowing on the primary coil side 121 of the ignition coil 120 reaches near a peak. This setting can bring about the maximum quantity of change in magnetic flux, resulting in generation of a higher secondary voltage on the secondary side of the ignition coil 120.

Even if the dielectric breakdown is not generated at the time T1, a higher negative voltage can be applied to the high voltage electrode 111 of the ignition plug 110 at the time T2, which is slightly later, and hence a dielectric breakdown is surely generated in the main plug gap, resulting in formation of the discharge path. Therefore, an ignition coil 120, which is small in turn ratio and can thus supply a larger secondary current, can be selected.

The discharge path is surely formed in the main plug gap at the time T2, and subsequently, generation of a high secondary voltage is no longer necessary unless the discharge is discontinued for a while. Therefore, the discharge current I2 can be cause to flow through the discharge path in the main plug gap between the high voltage electrode 111 and the outer electrode 112 of the ignition plug 110 by a voltage of approximately 500 V, for example.

An operation is the same as that of the above-mentioned first embodiment at and after a timing corresponding to the time T2 of FIG. 3, though the polarities of the voltage and the current are opposite, and a detailed description thereof is therefore omitted.

As described above, according to the second embodiment, the dielectric breakdown can be more efficiently generated in the main plug gap, and the discharge path is formed. Accordingly, an ignition coil small in turn ratio can be employed, and a larger discharge current can continuously be fed via the discharge path in the main plug gap.

Therefore, the large discharge plasma can be efficiently formed, and a large amount of plasma can be fed to a wide area in the combustion chamber of the internal combustion engine, thereby facilitating the combustion reaction. As a result, a limit region and the like of the lean combustion or the diluted combustion can be extended.

What is claimed is:

1. An ignition device for an internal combustion engine, comprising:

an ignition plug including a first electrode and a second electrode opposed to each other via a predetermined gap, for generating in the predetermined gap a spark discharge for igniting a combustible mixture in a combustion chamber of the internal combustion engine;

an ignition coil including a primary coil and a secondary coil, for generating a high voltage in the secondary coil by supplying or stopping a primary current flowing through the primary coil, and then applying the generated high voltage to the first electrode; and a control unit for driving the ignition coil for a plurality of times within a single ignition process, and changing a primary voltage for driving the ignition coil within the single ignition process, wherein the control unit comprises:

an ignition capacitor for providing the primary current; and a first switching element and a second switching element for driving the ignition coil and changing the primary voltage, wherein the ignition capacitor comprises:

a positive electrode side connected to a first power supply, a second power supply, and a first side of the primary coil; and a negative electrode side connected to ground through the second switching element, and wherein a second side of the primary coil is connected to a node between the negative electrode side and the second switching element through the first switching element.

2. An ignition device for an internal combustion engine according to claim 1, wherein:

the second power supply is higher in voltage than the first power supply; and the control unit sets a first primary voltage higher than second and subsequent primary voltages out of the primary voltages for driving the ignition coil within the single ignition process.

3. An ignition device for an internal combustion engine according to claim 1, wherein the control unit is configured to:

alternately generate positive and negative high voltages on the first electrode by driving the ignition coil so that a high voltage is alternately and continuously generated by exciting and releasing a magnetic flux; and provide control so that the high voltage generated for the first time, out of the high voltages generated for the plurality of times within the single ignition process, generates a positive high voltage on the first electrode of the ignition plug by means of the excitation of the magnetic flux of the ignition coil.

4. An ignition device for an internal combustion engine according to claim 2, wherein the control unit is configured to:

alternately generate positive and negative high voltages on the first electrode by driving the ignition coil so that a high voltage is alternately and continuously generated by exciting and releasing a magnetic flux; and provide control so that the high voltage generated for the first time, out of the high voltages generated for the plurality of times within the single ignition process, generates a positive high voltage on the first electrode of the ignition plug by means of the excitation of the magnetic flux of the ignition coil.

5. An ignition device for an internal combustion engine according to claim 1, wherein the control unit is configured to:

alternately generate positive and negative high voltages on the first electrode by driving the ignition coil so that a high voltage is alternately and continuously generated by exciting and releasing a magnetic flux; and provide control so that the high voltage generated for the first time, out of the high voltages generated for the plurality of times within the single ignition process, generates a negative high voltage on the first electrode by means of the excitation of the magnetic flux of the ignition coil.

6. An ignition device for an internal combustion engine according to claim 2, wherein the control unit is configured to:

alternately generate positive and negative high voltages on the first electrode by driving the ignition coil so that a high voltage is alternately and continuously generated by exciting and releasing a magnetic flux; and provide control so that the high voltage generated for the first time, out of the high voltages generated for the plurality of times within the single ignition process, generates a negative high voltage on the first electrode by means of the excitation of the magnetic flux of the ignition coil.

7. An ignition device for an internal combustion engine according to claim 1, wherein the control unit controls the ignition coil so that the magnetic flux of the ignition coil is released near a peak of the primary current flowing through the primary coil by applying the primary voltage.

8. An ignition device for an internal combustion engine according to claim 2, wherein the control unit controls the ignition coil so that the magnetic flux of the ignition coil is released near a peak of the primary current flowing through the primary coil by applying the primary voltage.

9. An ignition device for an internal combustion engine according to claim 3, wherein the control unit controls the ignition coil so that the magnetic flux of the ignition coil is released near a peak of the primary current flowing through the primary coil by applying the primary voltage.

10. An ignition device for an internal combustion engine according to claim 4, wherein the control unit controls the ignition coil so that the magnetic flux of the ignition coil is released near a peak of the primary current flowing through the primary coil by applying the primary voltage.

11. An ignition device for an internal combustion engine according to claim 5, wherein the control unit controls the ignition coil so that the magnetic flux of the ignition coil is released near a peak of the primary current flowing through the primary coil by applying the primary voltage.

12. An ignition device for an internal combustion engine according to claim 6, wherein the control unit controls the ignition coil so that the magnetic flux of the ignition coil is released near a peak of the primary current flowing through the primary coil by applying the primary voltage.

13. An ignition method for an internal combustion engine, the internal combustion engine comprising:

an ignition plug including a first electrode and a second electrode opposed to each other via a predetermined gap, for generating in the predetermined gap a spark discharge for igniting a combustible mixture in a combustion chamber of the internal combustion engine;

an ignition coil including a primary coil and a secondary coil, for generating a high voltage in the secondary coil by supplying or stopping a primary current flowing through the primary coil, and then applying the generated high voltage to the first electrode; and a control unit comprising: an ignition capacitor for providing the primary current; and a first switching element and a second switching element for driving the ignition coil and changing the primary voltage, wherein the ignition capacitor comprises: a positive electrode side connected to a first power supply, a second power supply, and a first side of the primary coil; and a negative electrode side connected to ground through the second switching element, and wherein a second side of the primary coil is connected to a node between the negative electrode side and the second switching element through the first switching element, the ignition method comprising driving the ignition coil for a plurality of times within a single ignition process, and changing a primary voltage for driving the ignition coil within the single ignition process.

* * * * *